US006670939B2

(12) United States Patent
Yang et al.

(10) Patent No.: US 6,670,939 B2
(45) Date of Patent: Dec. 30, 2003

(54) SINGLE-ENDED HIGH-VOLTAGE LEVEL SHIFTER FOR A TFT-LCD GATE DRIVER

(75) Inventors: Tsen-Shau Yang, Hsinchu (TW); Chin-Chieh Chao, Hsin Chu (TW); Chien-Kuo Wang, Hsinchu (TW)

(73) Assignee: Myson-Century, Inc. (TW)

( * ) Notice: Subject to any disclaimer, the term of this patent is extended or adjusted under 35 U.S.C. 154(b) by 347 days.

(21) Appl. No.: 09/893,213

(22) Filed: Jun. 26, 2001

(65) Prior Publication Data

US 2002/0135555 A1 Sep. 26, 2002

(30) Foreign Application Priority Data

Mar. 21, 2001 (TW) ..... 90106690 A

(51) Int. Cl.[7] ..... G09G 3/36

(52) U.S. Cl. ..... 345/98; 345/100; 345/204; 345/205; 345/211; 345/212; 345/214; 326/63; 326/80; 326/81; 327/333

(58) Field of Search ..... 345/98, 100, 204, 345/205, 211, 212, 214; 326/63, 80, 81; 327/333

(56) References Cited

U.S. PATENT DOCUMENTS 5,973,508 A * 10/1999 Nowak et al. ..... 326/81
6,359,491 B1 * 3/2002 Cairns et al. ..... 327/333
6,522,323 B1 * 2/2003 Sasaki et al. ..... 345/204
6,593,920 B2 * 7/2003 Okumura et al. ..... 345/204

* cited by examiner

*Primary Examiner*—Richard Hjerpe
*Assistant Examiner*—Jennifer T. Nguyen
(74) *Attorney, Agent, or Firm*—Martine & Penilla, LLP

(57) ABSTRACT

A single-ended high-voltage level shifter for a TFT-LCD gate driver comprises a high-voltage power supply and a low-voltage power supply, a low-voltage NMOS transistor, a high-voltage NMOS transistor, and a high-voltage PMOS transistor. An input signal is applied at the gate of the low-voltage NMOS transistor. The source of the low-voltage NMOS transistor is connected to the low-voltage power supply. The source of the high-voltage NMOS transistor is connected to the drain of the low-voltage NMOS transistor. The high-voltage NMOS transistor has a first reference voltage applied at its gate. The level of the first reference voltage is between the input-signal level and the high-voltage power supply. The drain of the high-voltage PMOS transistor is connected to the drain of the high-voltage NMOS transistor. The source of the high-voltage PMOS transistor is connected to the high-voltage power supply. The high-voltage PMOS transistor has a second reference voltage applied at its gate. The second reference voltage keeps the high-voltage PMOS transistor in ON-state and is at a level higher than the first reference voltage. The drain of the high-voltage PMOS transistor is employed as the output end connected to an output buffer of the next stage.

4 Claims, 6 Drawing Sheets

SINGLE-ENDED HIGH-VOLTAGE LEVEL SHIFTER FOR A TFT-LCD GATE DRIVER

FIELD OF THE INVENTION

The invention relates to a single-ended high-voltage level shifter for a TFT-LCD gate driver, and more particularly, to a single-ended high-voltage level shifter that minimizes the chip area of a TFT-LCD gate driver.

BACKGROUND OF THE INVENTION

A functional block diagram of a typical TFT-LCD gate driver with 256 output channels for XGA/SXGA display systems is shown in FIG. 1. The gate driver includes a bidirection shift control register, an enable control, a level shifter and an output buffer. The bidirection shift control register, triggered synchronously by the rising edge of a shift clock (SCLK), is used to continuously shift the start pulses of the right data input/output (DIOR) or the left data input/output (DIOL) according to the right/left shift control signal (RL). Each output channel of the gate driver is gated asynchronously by the global-on control signal (XON) and the output-enabled signal (OE). Then the voltage level of each output channel of the gate driver is translated to drive the output buffer of the next stage.

A conventional implementation of the level shifter 21 and the output buffer 22 is shown in FIG. 2. The level shifter 21 includes two high-voltage PMOS transistors M1, M3 and two high-voltage NMOS transistors M2, M4. Herein, the high-voltage MOS transistor is different from the low-voltage MOS transistor in that the high-voltage MOS transistor withstands higher drain-to-source or gate-to-source voltage than that of the low-voltage MOS transistor, for example: 40V. The threshold voltage $V_T$ of the high-voltage MOS transistor is also higher than the low-voltage MOS transistor. For example, the threshold voltage of the high-voltage PMOS transistor is 1.7V, and the threshold voltage of the high-voltage NMOS transistor is 2.7V. The input signal IN is used to drive the transistor M2, and the complementary input signal INB is used to drive the transistor M4.

When the gate of the transistor M2 receives an input low signal $V_{SS}$, the low-voltage power supply, for example: −5V. The transistor M2 is OFF and the transistor M4 is ON. The voltage of node B is pulled to $V_{SS}$, and the transistor M1 is ON. The voltage of node A is then pulled to the high-voltage power supply $V_{DD}$, for example: 25V~35V, then M3 is OFF. As a result, the transistor M6 is ON and the voltage of the output signal OUT is $V_{SS}$. When the input signal IN applied at the gate of the transistor M2 is changed from low to high, for example: −5V+3.3V=−1.7V, the transistor M2 is ON, and the transistor M4 is OFF. The voltage of node A is pulled to $V_{SS}$ and the transistor M3 is ON. The voltage of node B is pulled to $V_{DD}$. Then the transistor M1 is OFF. Because the voltage of node A is $V_{SS}$, the transistor M5 is ON and the voltage of the output signal OUT is pulled to $V_{DD}$.

The advantage of this conventional circuitry is that there is no static power consumption in the level shifter 21. However, the sizes of the high-voltage transistors M2 and M4 have to be designed much larger than those of the high-voltage transistors M1 and M3 as the high level of the input signal does not differ much from the threshold voltage of the high-voltage transistors M2 and M4. The reason is that when the high-voltage transistor M2 (or M4) is ON, the voltage of node A (or B) should be pulled from the high-voltage power supply $V_{DD}$ to the low-voltage power supply $V_{SS}$ in a short period of time. Thus the sizes of the high-voltage transistors M2 and M4 have to be designed large enough to sustain the large current. In addition, the high level of the input signal is necessarily higher than the threshold voltage of the high-voltage transistors M2 and M4 (typical of 2.7V) in order to drive the level shifter shown in FIG. 2.

FIG. 3 shows a circuit diagram having the level shifter 31 and the output buffer 32 connected together according to another prior art wherein the circuitry of the output buffer 32 is identical to that of the output buffer 22 shown in FIG. 2. The low-voltage transistors M7 and M8 receive the input signal IN and the complementary input signal INB respectively. The source of the high-voltage transistor M2 is connected to the drain of the low-voltage transistor M7 and the source of the high-voltage transistor M4 is connected to the drain of the low-voltage transistors M8. Both the gates of M2 and M4 are connected to a reference voltage $V_{RL}$ to limit the voltage of the drains of M7 and M8 not to exceed $V_{RL}-V_T$, for example: 5V−2.7V=2.3V. This is to prevent M7 (or M8) from breakdown when the voltage of drain-to-source of M7 (or M8) is excessively high. The advantage of this conventional circuitry is that the sizes of the high-voltage transistors M2 and M4 are not necessarily designed much larger than those of the high-voltage transistors M1 and M3 like the circuitry shown in FIG. 2. This is due to the employment of the low-voltage transistors M7 and M8. As a result, the chip area of the level shifter 31 is smaller than that of the level shifter 21.

Although the level shifter 31 occupies smaller chip area than the level shifter 21, the level shifter 31 still uses 4 high-voltage transistors that occupy significant chip area. Therefore, this plays an important role in determining the cost of the gate driver IC.

SUMMARY OF THE INVENTION

In view of the foregoing problems, the object of the invention is to provide a single-ended high-voltage level shifter for the TFT-LCD gate driver. Employing only two high-voltage transistors minimizes the chip area of the single-ended high-voltage level shifter. Implementing partial logic control circuitry in the level shifter further minifies the chip area of the TFT-LCD gate driver. Therefore, the total cost of the gate driver IC is significantly reduced.

The single-ended high-voltage level shifter for the TFT-LCD gate driver comprises (a) a high-voltage power supply and a low-voltage power supply; (b) a first low-voltage NMOS transistor, having its gate connected to an input signal and its source connected to the low-voltage power supply; (c) a high-voltage NMOS transistor, having its gate received a first reference voltage whose level is between the input-signal level and the high-voltage power supply, and having its source connected to the drain of the first low-voltage NMOS transistor; (d) a first high-voltage PMOS transistor, having its gate received a second reference voltage that keeps the first high-voltage PMOS transistor in ON-state and is at a level higher than the first reference voltage, and having its source connected to the high-voltage power supply, and having its drain connected to the drain of the high-voltage NMOS transistor and employed as the output end connected to an output driver of the next stage.

DETAILED DESCRIPTION OF THE PREFERRED EMBODIMENTS

Figure 1:
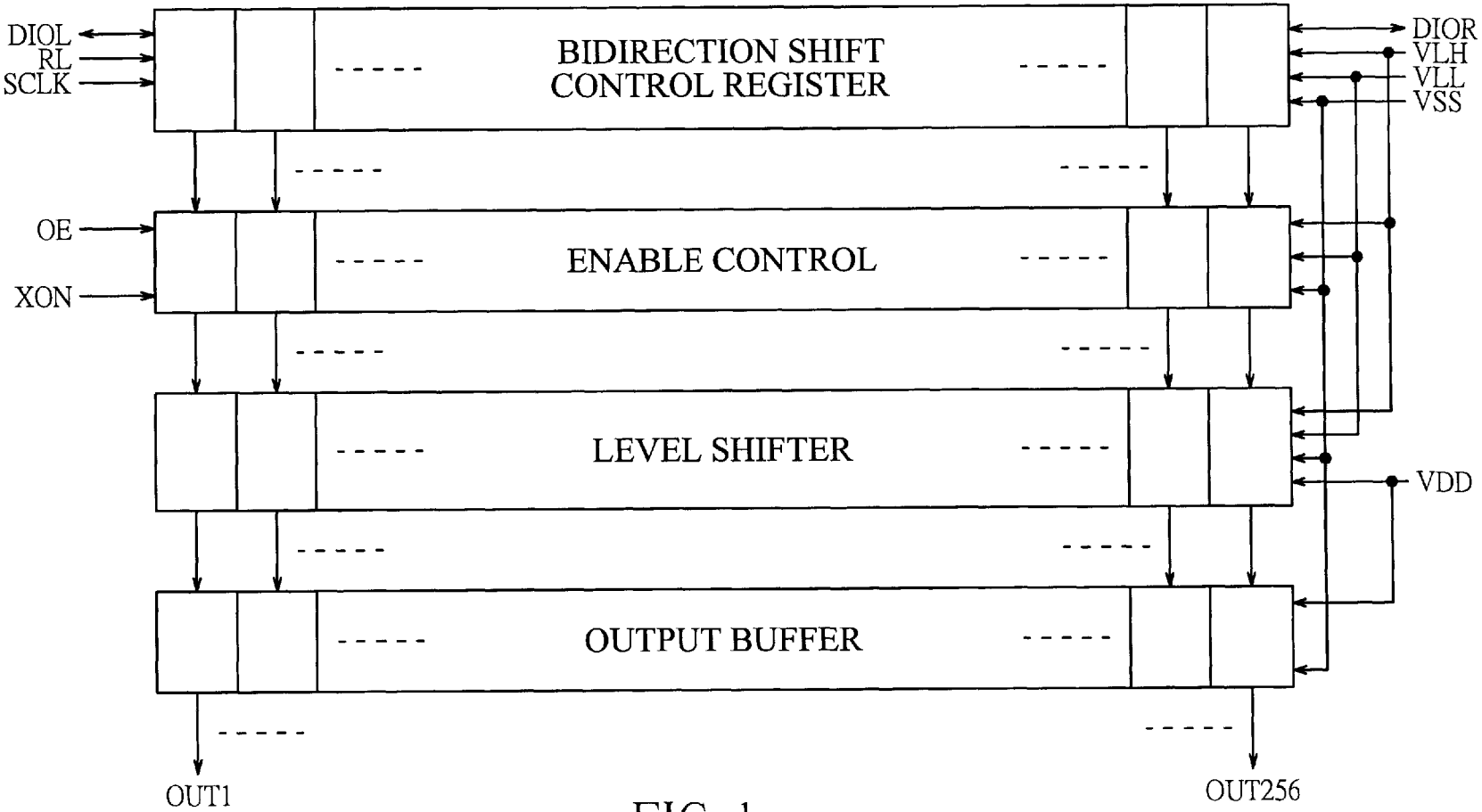
FIG. 1 (PRIOR ART)
FIG. 1 shows a functional block diagram of a typical TFT-LCD gate driver with 256 output channels for XGA/SXGA display systems.
Figure 2:
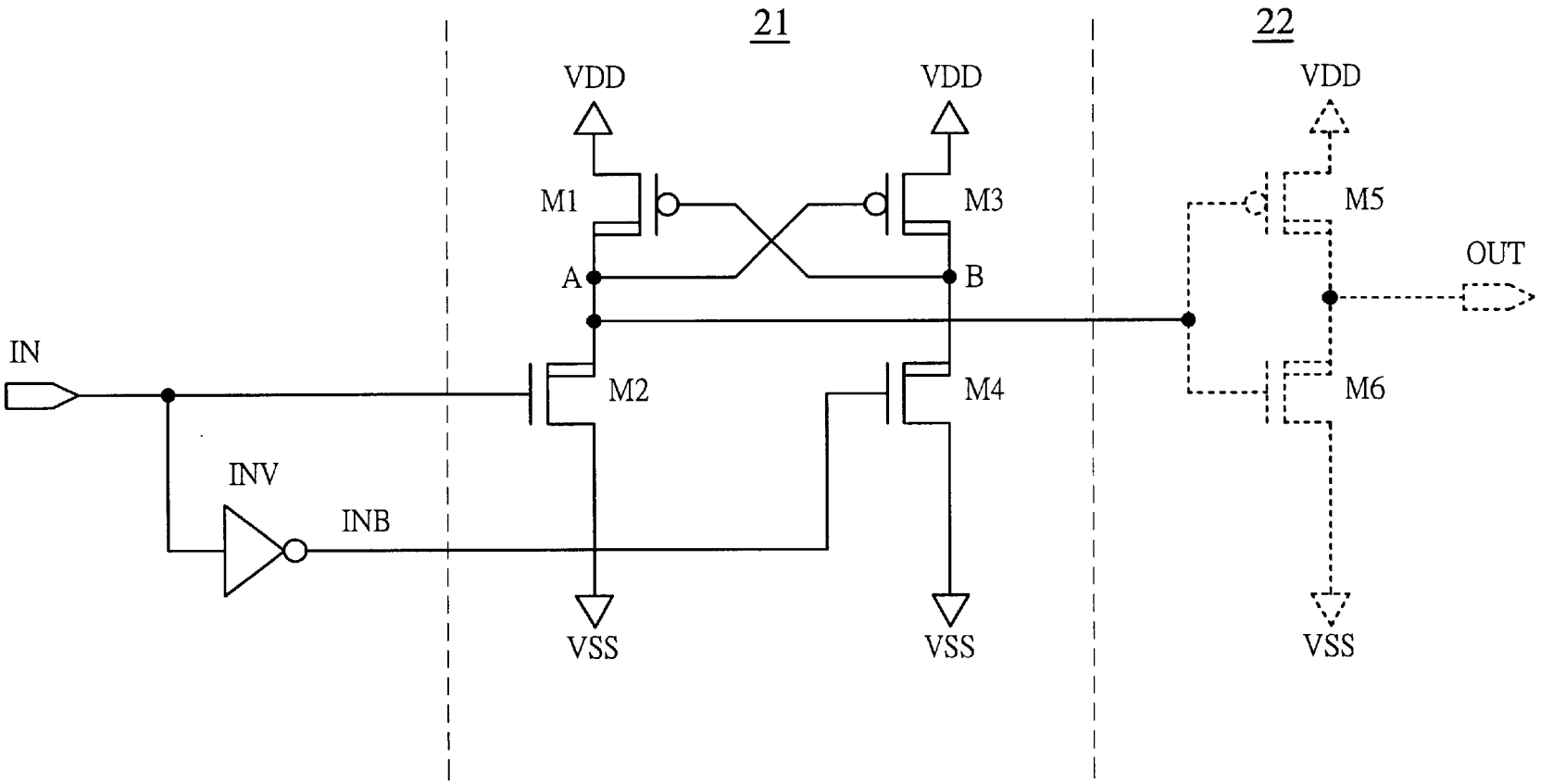
FIG. 2 (PRIOR ART)
FIG. 2 shows an implementation of the level shifter and the output buffer according to the prior art.
Figure 3:
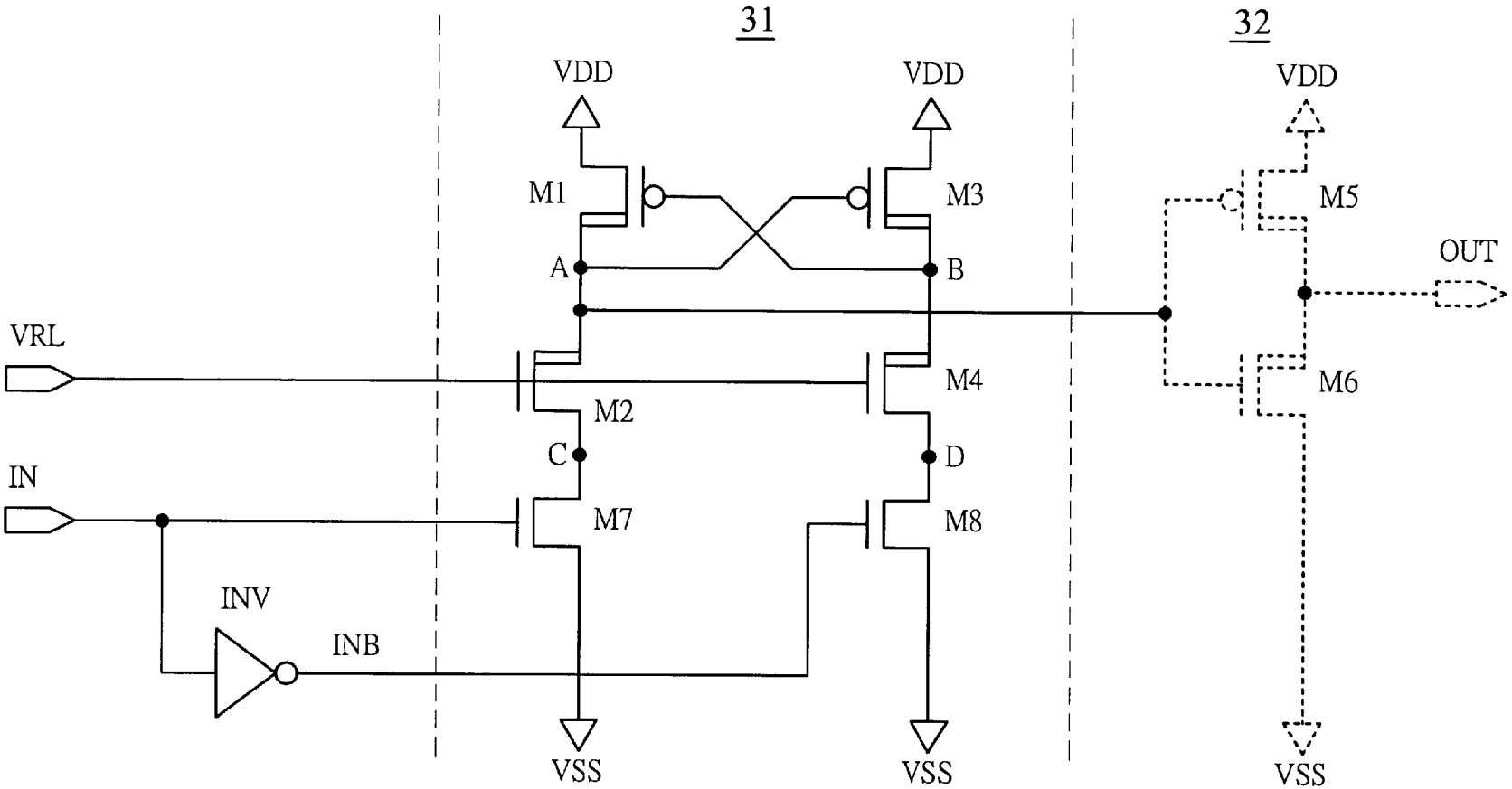
FIG. 3 (PRIOR ART)
FIG. 3 shows another implementation of the level shifter and the output buffer according to the prior art.
Figure 4:
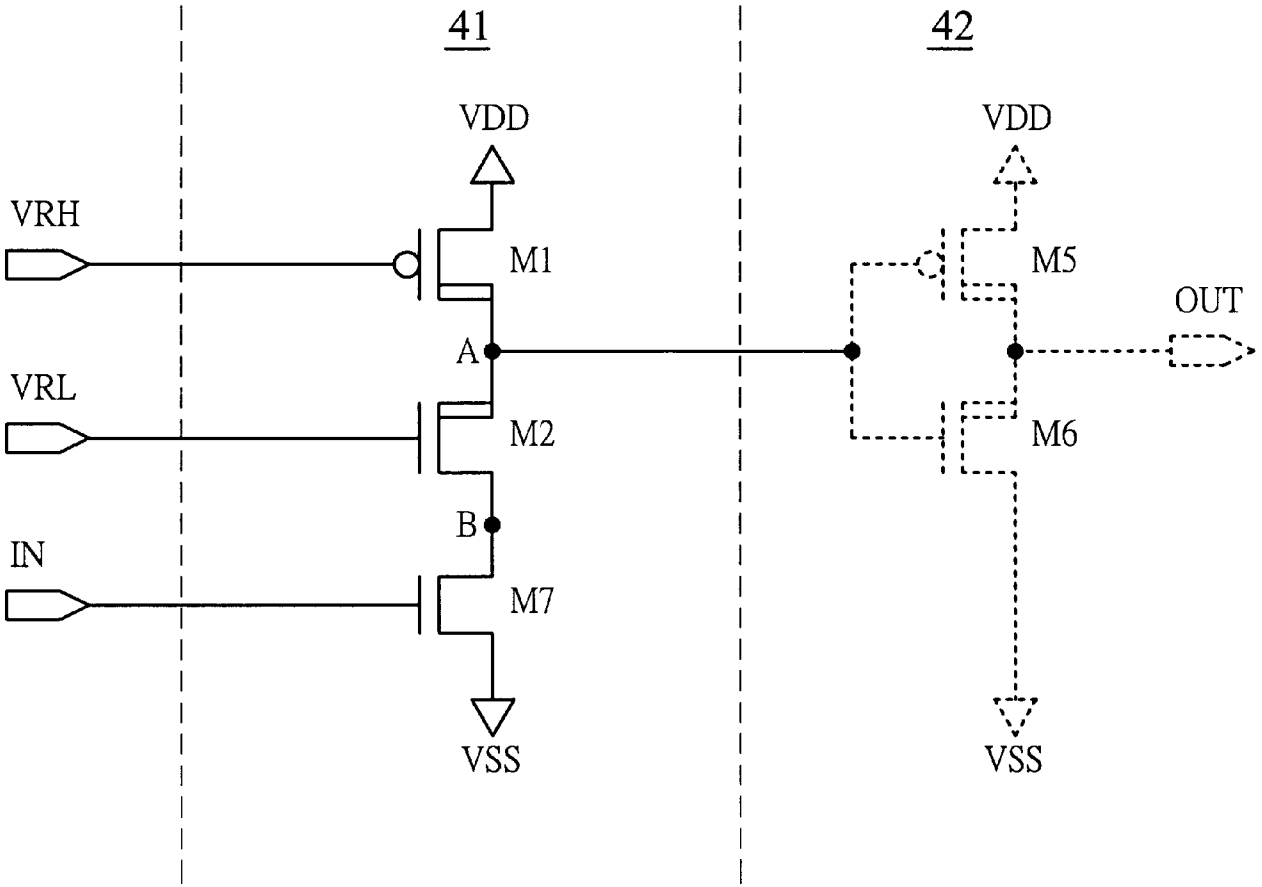
FIG. 4 shows a level shifter of the invention and an output buffer.

Referring to FIG. 4, the single-ended high-voltage level shifter for the TFT-LCD gate driver includes a high-voltage power supply $V_{DD}$ and a low-voltage power supply $V_{SS}$, a high-voltage PMOS transistor M1, a high-voltage NMOS transistor M2, and a low-voltage NMOS transistor M7. The high-voltage power supply $V_{DD}$ is applied at the source of M1. The low-voltage power supply $V_{SS}$ is applied at the source of M7. A first reference voltage $V_{RL}$, whose level is between the input-signal level and the high-voltage power supply, is applied at the gate of M2. This is to limit the voltage of the drain of M7 to be lower than $V_{RL}-V_T$ in order to prevent M7 from breakdown. A second reference voltage $V_{RH}$, whose level is higher than that of the first reference voltage, is applied at the gate of M1 to ensure that M1 is under operating state. For example: $V_{DD}$=30V, $V_{SS}$=−5V, $V_{RL}$=5V, $V_T$=2.7V, $V_{RH}$=24V. The level of the aboriginal high signal $V_{LH}$ is translated to $V_{AA}$ and the level of the aboriginal low signal $V_{LL}$ is translated to $V_{SS}$, wherein $V_{AA}=V_{SS}+(3.3V\sim5.5V)$.

When an input high signal $V_{AA}$ is applied at the gate of M7, M7 is ON. The voltage of node B is pulled to $V_{SS}$, M2 is ON. The voltage of node A is pulled to $V_{SS}$. M5 is ON and M6 is OFF. Then the voltage of the output signal OUT is $V_{DD}$. When the input high signal $V_{AA}$ is changed to an input low signal $V_{SS}$, M7 is OFF. During the transition state of M2, the voltage of node B gradually rises because of the charging current. When the voltage of node B rises up to $V_{RL}-V_T$, M2 is OFF. M1 is ON due to the fact that $V_{Source\text{-}to\text{-}Gate}>V_T$ is satisfied. Then the voltage of node A rises up to $V_{DD}$ because of the charging current. As a result, M6 is ON and the voltage of the output signal OUT is pulled to $V_{SS}$. For example: $V_{AA}$=−1.7V, $V_{SS}$=−5V, $V_{DD}$=30V, $V_{RL}$=5V, $V_{RH}$=24V.

When the input high signal $V_{AA}$ is applied at the gate of M7, there is static current in the level shifter 41 because M1, M2 and M7 are ON. However, because there is only one of the 256 output channels outputting static current all the time, this is not a crucial issue.

Figure 5:
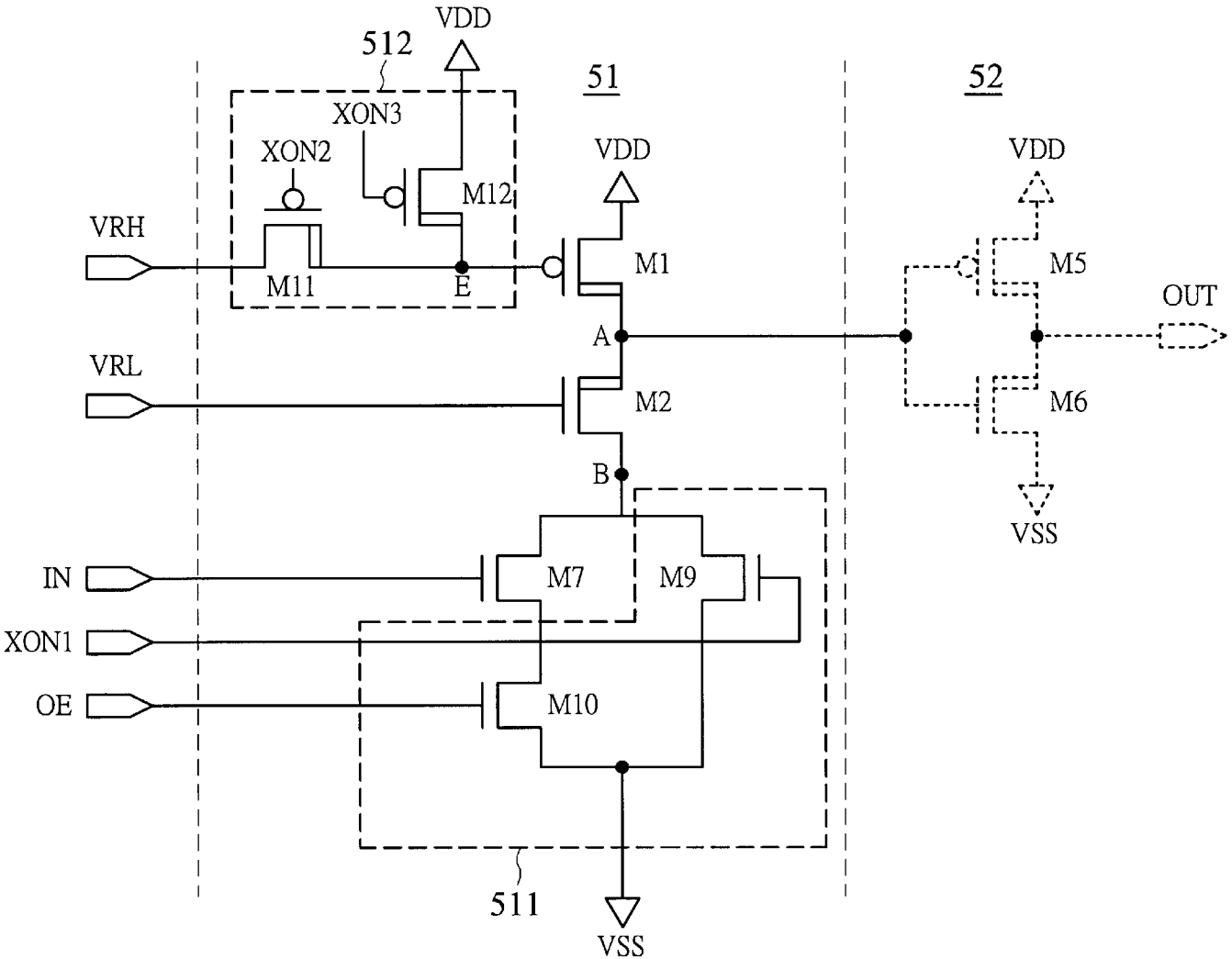
FIG. 5 shows a level shifter of the invention with partial logic control circuitry and an output buffer.

The chip area of the single-ended high-voltage level shifter 41 is minimized because the number of the high-voltage transistors is minimized. Moreover, by implementing partial logic control circuitry in the single-ended high-voltage level shifter 41, the chip area of the TFT-LCD gate driver is further minified. Referring to FIG. 5, the partial circuitry 511 includes two low-voltage NMOS transistors M9 and M10. Each level shifter of the 256 output channels has the same partial circuitry 511 independently. The gate of the NMOS transistor M9 receives a first global-on control signal XON1 while the gate of the NMOS transistor M10 receives an output-enabled signal OE. The partial circuitry 512 includes two high-voltage PMOS transistors M11 and M12. Each level shifter of the 256 output channels has the partial circuitry 512 in common. The gate of high-voltage PMOS transistor M11 receives a second global-on control signal XON2 while the gate of the high-voltage PMOS transistor M12 receives a third global-on control signal XON3.

The global-on control signals XON1, XON2 and XON3 are employed to control the mode of gate driver. When the voltage $V_{SS}$ is applied at XON1 and XON2, and the voltage $V_{DD}$ is applied at XON3, only one of the 256 output channels is in ON-state. This is the normal mode of the gate driver. When the voltage $V_{AA}$ is applied at XON1, M9 is ON. Then the voltage of nodes A and B is pulled to $V_{SS}$. Now be careful that there is static current in the level shifter 51. If all 256 output channels have static current at the same time, there will be very large static power consumption. To prevent this from happening, the voltage $V_{DD}$ is applied at XON2 and the voltage $V_{SS}$ is applied at XON3 so that M11 is OFF and M12 is ON. Then the voltage of node E is $V_{DD}$, and thereby M1 is OFF. Thus there is no static current in the level shifter 51. In this case, the gate driver is in all-in-ON mode in which all of the 256 output channels are in ON-state. The output-enabled signal OE is employed to enable the output signal OUT. Whenever the voltage $V_{AA}$ is applied at OE, the matching output channel enables the output signal OUT. When the voltage $V_{SS}$ is applied at OE and the gate driver is in the normal mode, the voltage of the output signal OUT is pulled to $V_{SS}$.

Figure 6:
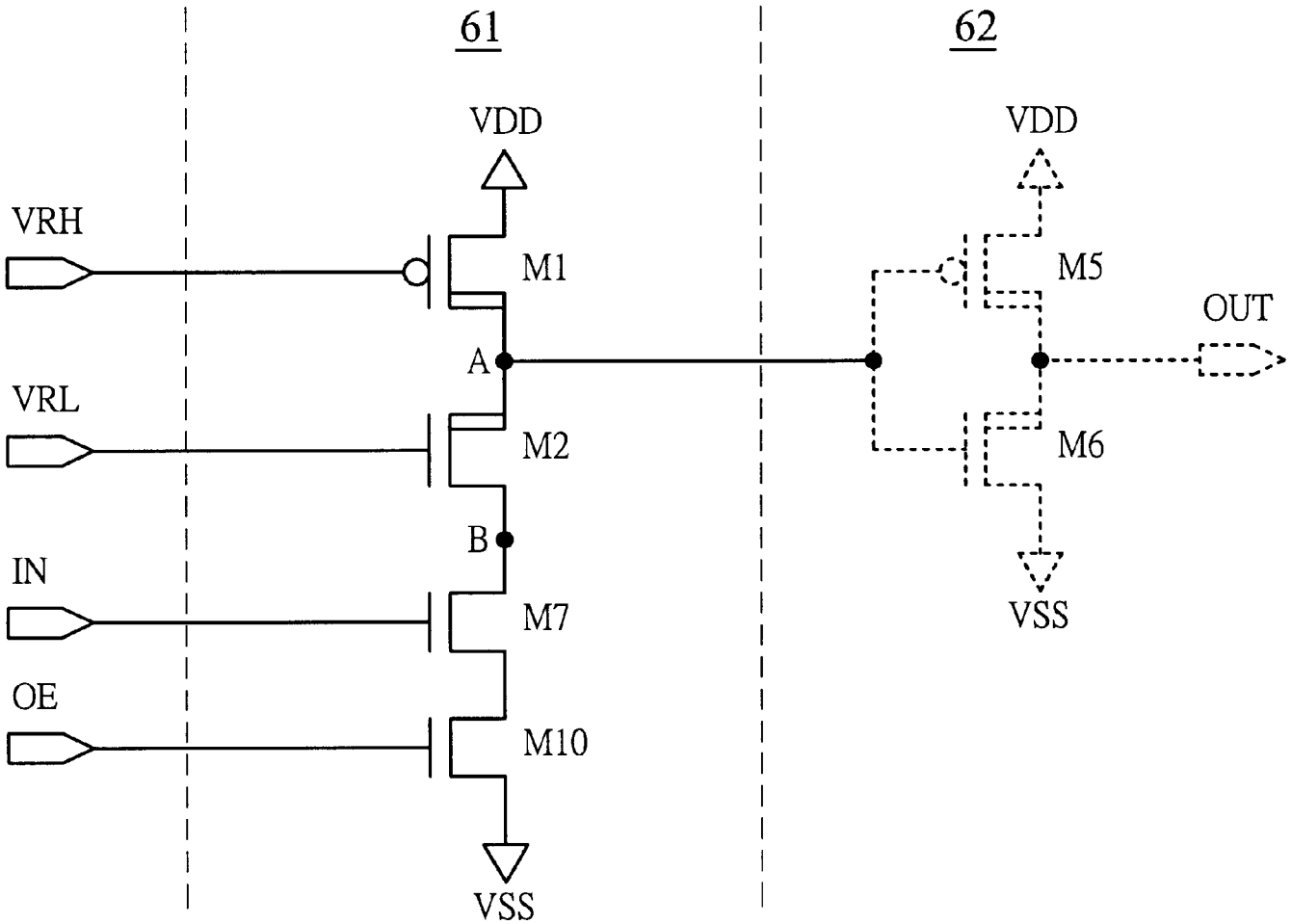
FIG. 6 shows the simplified circuitry of FIG. 5.

The above description according to the voltages $V_{SS}$, $V_{AA}$ and $V_{DD}$ applied at XON1, XON2, XON3 and OE is concluded in three cases. (1) The voltage $V_{SS}$ is applied at XON1 and XON2, the voltage $V_{DD}$ is applied at XON3, and the voltage $V_{AA}$ is applied at OE. In this case, only one of the 256 output channels is in ON-state. This is the normal mode of the gate driver. The circuitry of FIG. 6, being the simplified circuitry of FIG. 5, has the same function with the circuitry of FIG. 4. (2) The voltage $V_{SS}$ is applied at XON1 and XON2, the voltage $V_{DD}$ is applied at XON3, and the voltage $V_{SS}$ is applied at OE. In this case, M9 and M10 are OFF. The voltage of the output signal OUT is pulled to $V_{SS}$. (3) The voltage $V_{AA}$ is applied at XON1, the voltage $V_{DD}$ is applied at XON2, the voltage $V_{SS}$ is applied at XON3, and either the voltage $V_{AA}$ or the voltage $V_{SS}$ is applied at OE. M9 is ON and M1 is OFF. The voltage of the output signal OUT is pulled to $V_{DD}$. In this case, the gate driver is in all-in-ON mode in which all of the 256 output channels are in ON-state. The voltage of all 256 output channels is pulled to $V_{DD}$. In addition, there is no static power consumption in this case because no static current exits.

While the invention has been described in terms of the preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A single-ended high-voltage level shifter for a TFT-LCD gate driver comprising:

(a) a high-voltage power supply and a low-voltage power supply;

(b) a first low-voltage NMOS transistor, having its gate connected to an input signal and its source connected to the low-voltage power supply;

(c) a high-voltage NMOS transistor, having its gate received a first reference voltage whose level is between the input-signal level and the high-voltage power supply, and having its source connected to the drain of the first low-voltage NMOS transistor; and (d) a first high-voltage PMOS transistor, having its gate received a second reference voltage that keeps the first high-voltage PMOS transistor in ON-state and is at a level higher than the first reference voltage, and having its source connected to the high-voltage power supply, and having its drain connected to the drain of the high-voltage NMOS transistor and employed as the output end connected to an output driver of the next stage.

2. A single-ended high-voltage level shifter for a TFT-LCD gate driver comprising:

(a) a high-voltage power supply and a low-voltage power supply;

(b) a first low-voltage NMOS transistor, having its gate connected to an input signal and its source connected to the low-voltage power supply;

(c) a high-voltage NMOS transistor, having its gate received a first reference voltage whose level is between the input-signal level and the high-voltage power supply, and having its source connected to the drain of the first low-voltage NMOS transistor; and (d) a first high-voltage PMOS transistor, having its source connected to the high-voltage power supply, and having its drain connected to the drain of the high-voltage NMOS transistor and employed as the output end connected to an output driver of the next stage;

(e) a second low-voltage NMOS transistor, having its gate received a first control signal that determines the second low-voltage NMOS transistor ON and OFF, and having its source connected to the low-voltage power supply, and having its drain connected to the drain of the first low-voltage NMOS transistor;

(f) a second high-voltage PMOS transistor, having its gate received a second control signal that determines the second high-voltage PMOS transistor ON and OFF, and having either its source or its drain received a second reference voltage that keeps the first high-voltage PMOS transistor in ON-state and is at a level higher than the first reference voltage while the other one connected to the gate of the first high-voltage PMOS transistor; and (g) a third high-voltage PMOS transistor, having its gate received a third control signal that determines the third high-voltage PMOS transistor ON and OFF, and having its source connected to the high-voltage power supply, and having its drain connected to the gate of the first high-voltage PMOS transistor;

wherein (1) the gate driver is in a normal mode in which only one of the plural output channels of the gate driver is in ON-state when the second low-voltage NMOS transistor is OFF, the second high-voltage PMOS transistor is ON, and the third high-voltage PMOS transistor is OFF; (2) the gate driver is in all-in-ON mode in which all of the plural output channels of the gate driver are in ON-state when the second low-voltage NMOS transistor is ON, the second high-voltage PMOS transistor is OFF and the third high-voltage PMOS transistor is ON.

3. A single-ended high-voltage level shifter for a TFT-LCD gate driver comprising:

(a) a high-voltage power supply and a low-voltage power supply;

(b) a first low-voltage NMOS transistor, having its gate connected to an input signal;

(c) a third low-voltage NMOS transistor, having its gate received a fourth control signal that determines the third low-voltage NMOS transistor ON and OFF, and having its source connected to the low-voltage power supply, and having its drain connected to the source of the first low-voltage NMOS transistor;

(d) a high-voltage NMOS transistor, having its gate received a first reference voltage whose level is between the input-signal level and the high-voltage power supply, and having its source connected to the drain of the first low-voltage NMOS transistor; and (e) a first high-voltage PMOS transistor, having its gate received a second reference voltage that keeps the first high-voltage PMOS transistor in ON-state and is at a level higher than the first reference voltage, and having its source connected to the high-voltage power supply, and having its drain connected to the drain of the high-voltage NMOS transistor and employed as the output end connected to an output driver of the next stage.

4. A single-ended high-voltage level shifter for a TFT-LCD gate driver comprising:

(a) a high-voltage power supply and a low-voltage power supply;

(b) a first low-voltage NMOS transistor, having its gate connected to an input signal;

(c) a second low-voltage NMOS transistor, having its gate received a first control signal that determines the second low-voltage NMOS transistor ON and OFF, and having its source connected to the low-voltage power supply, and having its drain connected to the drain of the first low-voltage NMOS transistor;

(d) a third low-voltage NMOS transistor, having its gate received a fourth control signal that determines the third low-voltage NMOS transistor ON and OFF, and having its source connected to the low-voltage power supply, and having its drain connected to the source of the first low-voltage NMOS transistor;

(e) a high-voltage NMOS transistor, having its gate received a first reference voltage whose level is between the input-signal level and the high-voltage power supply, and having its source connected to the drain of the first low-voltage NMOS transistor;

(f) a first high-voltage PMOS transistor, having its source connected to the high-voltage power supply, and having its drain connected to the drain of the high-voltage NMOS transistor and employed as the output end connected to an output driver of the next stage;

(g) a second high-voltage PMOS transistor, having its gate received a second control signal that determines the second high-voltage PMOS transistor ON and OFF, and having either its source or its drain received a second reference voltage that keeps the first high-voltage PMOS transistor in ON-state and is at a level higher than the first reference voltage while the other one connected to the gate of the first high-voltage PMOS transistor; and (h) a third high-voltage PMOS transistor, having its gate received a third control signal that determines the third high-voltage PMOS transistor ON and OFF, and having its source connected to the high-voltage power supply, and having its drain connected to the gate of the first high-voltage PMOS transistor;

wherein (1) the gate driver is in a normal mode in which only one of the plural output channels of the gate driver is in ON-state when the second low-voltage NMOS transistor is OFF, the third low-voltage NMOS transistor is ON, the second high-voltage PMOS transistor is ON and the third high-voltage PMOS transistor is OFF; (2) the voltage of the output end of the level shifter is pulled to the high-voltage power supply when the second low-voltage NMOS transistor is OFF, the third low-voltage NMOS transistor is OFF, the second high-voltage PMOS transistor is ON and the third high-voltage PMOS transistor is OFF; (3) the gate driver is in all-in-ON mode in which all of the plural output channels of the gate driver are in ON-state when the second low-voltage NMOS transistor is ON, the second high-voltage PMOS transistor is OFF, the third high-voltage PMOS transistor is ON and the third low-voltage NMOS transistor is either ON or OFF.

* * * * *